US005465743A

United States Patent [19]

Sheu et al.

[11] Patent Number: 5,465,743

[45] Date of Patent: Nov. 14, 1995

[54] SHEATHING DEVICE FOR UMBRELLA

[76] Inventors: Miin-Tsang Sheu, No. 156, Cheng Kung Road, Chang Hua City; Mon-Teng Liu, No. 15, 314 Lane, An Pyng Load, Tainan City, both of Taiwan

[21] Appl. No.: 310,704

[22] Filed: Sep. 22, 1994

[51] Int. Cl.[6] ..... A45B 15/00

[52] U.S. Cl. ..... 135/34.2; 224/915

[58] Field of Search ..... 135/16, 48, 34.2, 135/33.4, 33.41, 33.6, 43, 44; 224/915

[56] References Cited

U.S. PATENT DOCUMENTS

| | | | |
|---|---|---|---|
| 564,241 | 7/1896 | Boustead | 135/33.41 |
| 739,494 | 9/1903 | Johnson | 135/48 |
| 1,031,916 | 7/1912 | Davis | 135/48 |
| 1,134,121 | 4/1915 | Goldstein | 135/33.4 |
| 2,350,227 | 5/1944 | Goldstein | 135/33.4 |
| 2,690,187 | 9/1954 | Thompson | 135/48 X |
| 2,716,994 | 9/1955 | Torricelli | 135/34.2 |
| 5,135,017 | 8/1992 | Fujiyama | 135/48 X |
| 5,146,940 | 9/1992 | Hamada | 135/34.2 |
| 5,195,550 | 3/1993 | Chan | 135/48 |

FOREIGN PATENT DOCUMENTS

| | | | |
|---|---|---|---|
| 0382123 | 1/1908 | France | 135/33.41 |
| 59-21215 | 2/1984 | Japan | 135/34.2 |

*Primary Examiner*—Lanna Mai
*Attorney, Agent, or Firm*—Bacon & Thomas

[57] ABSTRACT

A sheathing device for receiving wet umbrella in order to collect water. The device includes a flexible tubular member having a handle and a cap secured to the ends. The cap includes an enclosed end having an orifice for engaging with a plug and for releasing collected water. Two lock rings are secured to the cap and the handle for securing the ends of the tubular member, It is preferable that the handle includes a larger size than the cap such that the water can be collected in the tubular member close to the cap.

8 Claims, 3 Drawing Sheets

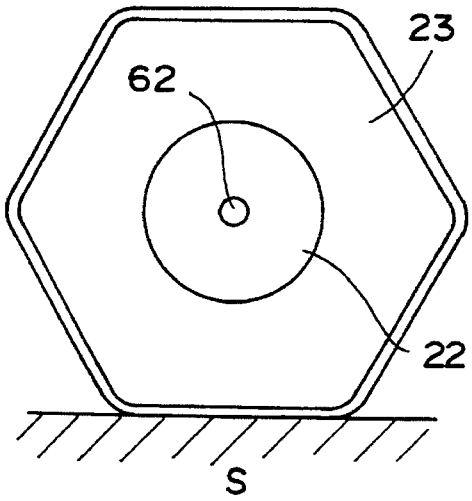
FIG. 4
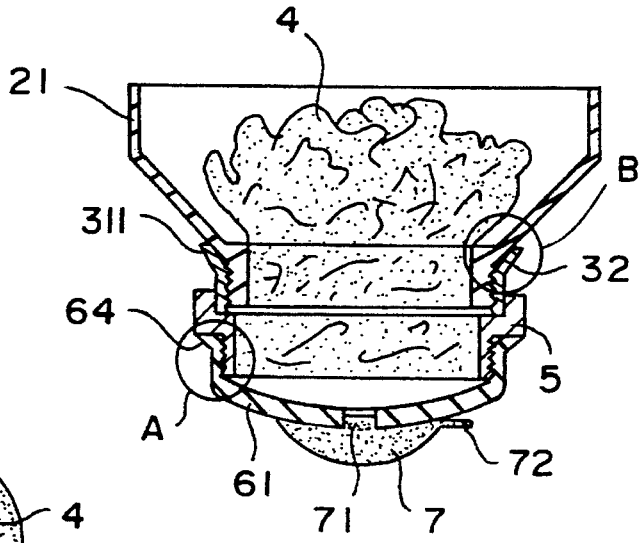
FIG. 2
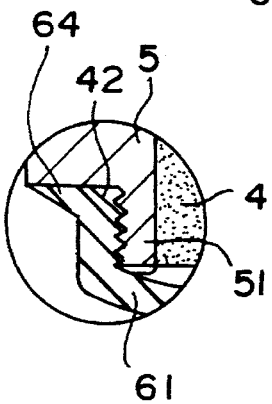
FIG. 2-A
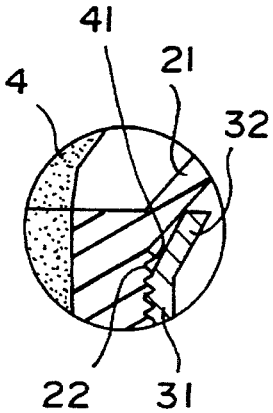
FIG. 2-B

SHEATHING DEVICE FOR UMBRELLA

BACKGROUND OF THE INVENTION

1. Field of the Invention

The present invention relates to a sheathing device, and more particularly to a sheathing device for umbrella.

2. Description of the Prior Art

A typical long and flexible sleeve which is made of plastic film is provided for receiving umbrella, after use, in raining days. However, the sleeves may be used for one time only and should be discarded after use. In addition, the umbrella may not be easily inserted into the sleeves. Furthermore, the collected water may easily flow out of the sleeve when the umbrella is disposed horizontally on the ground.

The present invention has arisen to mitigate and/or obviate the afore-described disadvantages of the conventional devices for accommodating umbrella.

SUMMARY OF THE INVENTION

The primary objective of the present invention is to provide a sheathing device for receiving wet umbrella and for collecting water.

In accordance with one aspect of the invention, there is provided a sheathing device for receiving umbrella comprising a flexible tubular member for receiving the umbrella and including a first end and a second end, a handle member secured to the first end of the tubular member, and a cap secured to the second end of the tubular member and including an enclosed end portion.

The enclosed end portion of the cap includes an orifice formed therein, the cap includes a plug means for enclosing the orifice and for opening the orifice for releasing collected water. The plug means includes a projection engaged in the orifice and includes an ear for disengaging the plug means from the cap.

The cap includes a first thread means formed therein and includes a lock ring having a second thread means for engaging with the first thread means of the cap so as to lock the second end of the tubular member therein. The cap includes a skirt inclined radially outward therefrom for engaging with the lock ring.

The handle member includes a first thread means formed therein and includes a lock ring having a second thread means for engaging with the first thread means of the handle member so as to lock the first end of the tubular member therein. The lock ring includes a skirt inclined radially outward therefrom for engaging with the handle member.

The handle member includes an outer diameter larger than that of the cap. The handle member includes a cylindrical configuration or a polygon configuration.

Further objectives and advantages of the present invention will become apparent from a careful reading of a detailed description provided hereinbelow, with appropriate reference to accompanying drawings.

BRIEF DESCRIPTION OF THE DRAWINGS

FIG. 2 is a cross sectional view of the sheathing device which is arranged in the folded configuration;

FIGS. 2A and 2B are enlarged partial cross sectional views showing portions A and B in FIG. 2 of the sheathing device;

FIG. 4 is an end view illustrating another application of the sheathing device.

DETAILED DESCRIPTION OF THE PREFERRED EMBODIMENT

Figure 1:
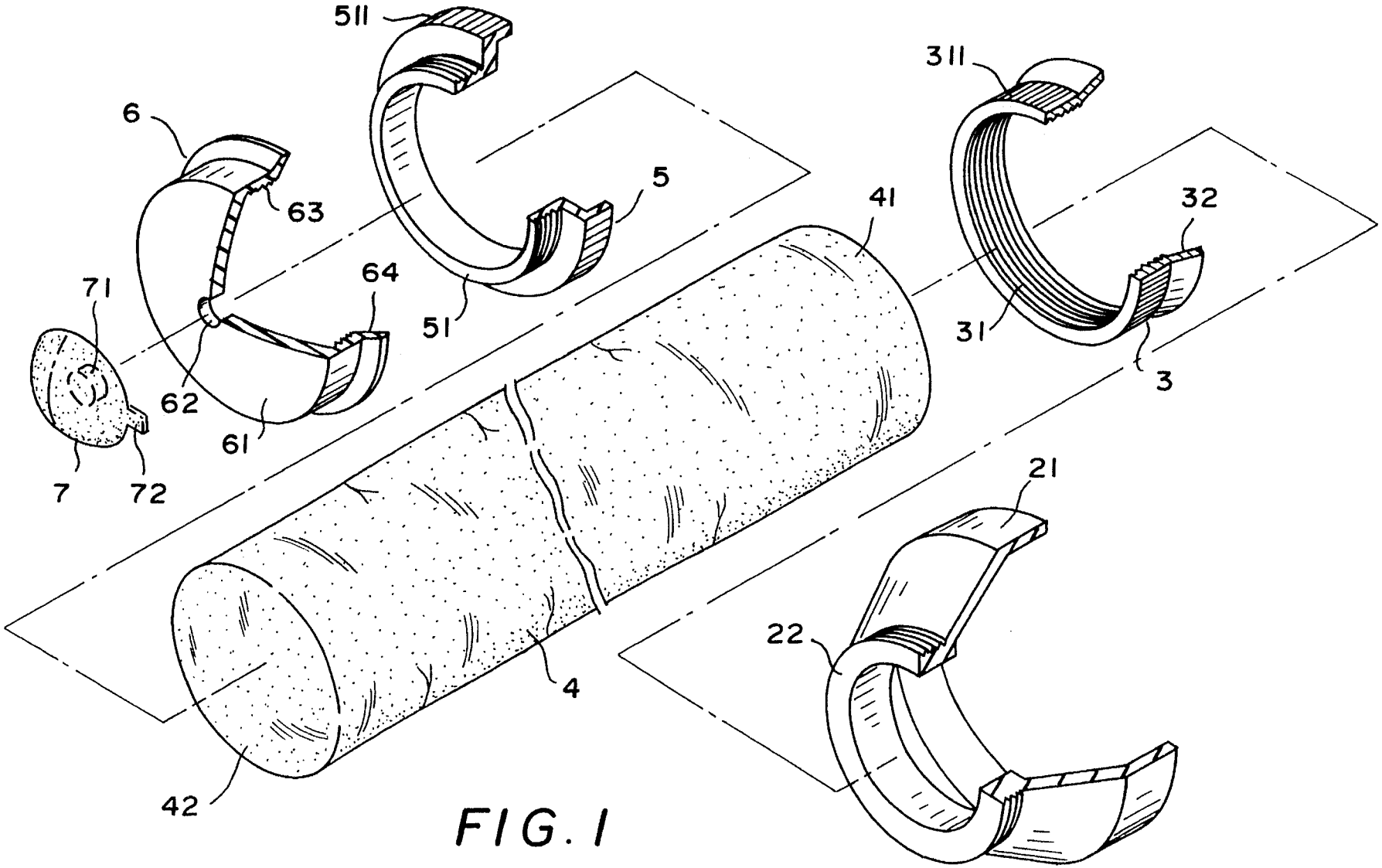
FIG. 1 is an exploded view of a sheathing device for umbrella in accordance with the present invention.

Referring to the drawings, and initially to FIGS. 1, 2, 2A and 2B, a sheathing device for umbrella in accordance with the present invention comprises a handle member 21 including a reduced diameter portion 22 having an outer thread formed thereon for engaging with an inner thread 31 of a lock ring 3. The lock ring 3 includes an embossed outer peripheral surface 311 and includes a skirt 32 which is slightly inclined radially outward relative to the lock ring 3 for engaging with the handle member 21 (FIG. 2B). A cap 6 includes an enclosed end 61 having an orifice 62 formed therein and includes an inner thread 63 formed therein for engaging with an outer thread 51 of a lock ring 5. The lock ring 5 also includes an embossed outer peripheral surface 511 for facilitating rotation of the lock ring 5. The cap 6 also includes a skirt 64 slightly inclined radially outward for engaging with the lock ring 5 (FIG. 2A). A plug 7 includes a projection 71 for force-fitting in the orifice 62 of the cap 6 and includes an ear 72 for disengaging the plug 7 from the cap 6. A flexible tubular member 4 includes one end 41 engaged between the handle member 21 and the lock ring 3 (FIG. 2B) and the other end 42 engaged between the cap 6 and the lock ring 5 (FIG. 2A) so as to form two water tight seals therewith. As best shown in FIG. 2, the lock ring 3 may be engaged in the lock ring 5 for storing purposes.

Figure 3:
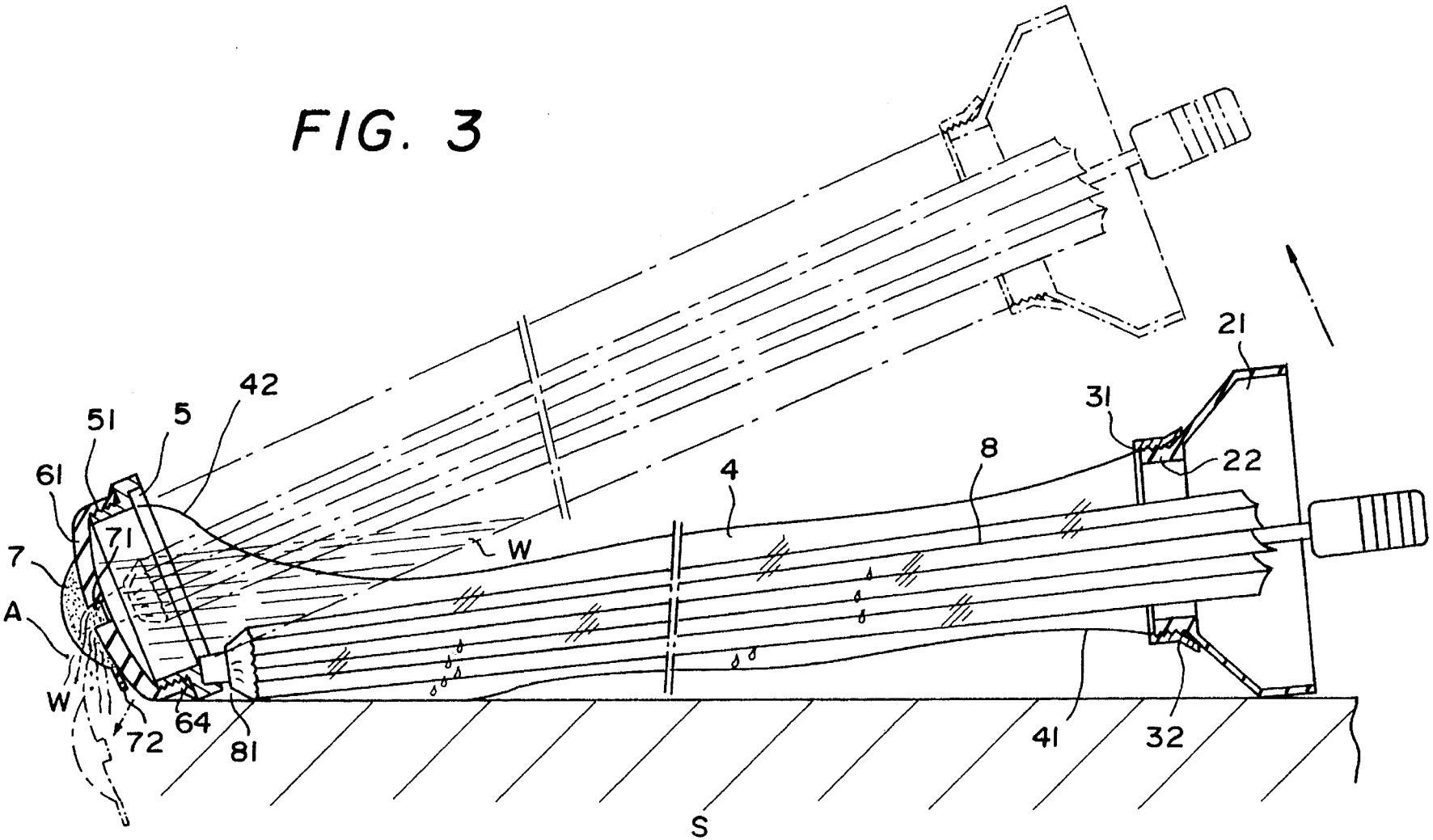
FIG. 3 is a schematic view illustrating the operation of the sheathing device.

Referring next to FIG. 3, an umbrella 8 may be received in the tubular member 4 and includes a tip portion 81 for pushing the projection 71 of the plug 7 so as to disengage the plug 7 from the cap 6 and so as to release collected water W and contamination A. Alternatively, the plug 7 may also be disengaged from the cap 6 by pulling the ear 72. It is preferable that the handle member 21 includes an outer diameter larger than that of the cap 6 and the lock ring 5 such that the end portion 41 of the tubular member 4 is higher than the other end portion 42 and such that the water may be suitably collected in the end portion 42 when the umbrella is disposed on the ground S.

Referring next to FIG. 4, alternatively, the handle member 23 may be formed to include a hexagonal shape such that the handle member 23 may be stably supported on the ground S.

Accordingly, the sheathing device in accordance with the present invention may be suitably used for receiving wet umbrella and for collecting water.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A sheathing device for receiving an umbrella comprising:

a flexible tubular member for receiving said umbrella and including a first end and a second end;

a handle member secured to said first end of said tubular member wherein said handle member includes a first thread means formed thereon and includes a first lock ring having a second thread means for engaging with said first thread means of said handle member so as to attach said first end of said tubular member thereto; and, a cap secured to said second end of said tubular member and including an enclosed end portion, wherein said cap includes a third thread means formed thereon and includes a second lock ring having a fourth thread means for engaging with said third thread means of said cap so as to attach said second end of said tubular member thereto, the second lock ring having a recess to accept a portion of the first lock ring to facilitate storage of the sheathing device.

2. The sheathing device according to claim 1, wherein said enclosed end portion of said cap has an orifice formed therein, and further comprising a plug means removably closing said orifice, whereby said plug means is removable for opening said orifice for releasing water collected in the sheathing device.

3. The sheathing device according to claim 2, wherein said plug means comprises a projection engaged in said orifice and and ear for enabling disengagement of said plug means from said cap.

4. The sheathing device according to claim 1, wherein said cap includes a skirt inclined radially outward therefrom for engaging said second lock ring.

5. The sheathing device according to claim 1, wherein said first lock ring includes a skirt inclined radially outward therefrom for engaging said handle member.

6. The sheathing device according to claim 1, wherein said handle member comprises a portion having an outer diameter larger than an outer diameter of said cap.

7. The sheathing device according to claim 1, wherein said handle member has a cylindrical configuration.

8. The sheathing device according to claim 1, wherein said handle member has a polygonal cross-sectional configuration.

* * * * *